US008176812B2

(12) United States Patent
Smith et al.

(10) Patent No.: US 8,176,812 B2
(45) **Date of Patent: *May 15, 2012**

(54) METHODS OF FORMING BODIES OF EARTH-BORING TOOLS

(75) Inventors: Redd H. Smith, The Woodlands, TX (US); John H. Stevens, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/870,515

(22) Filed: Aug. 27, 2010

(65) Prior Publication Data

US 2010/0319492 A1 Dec. 23, 2010

Related U.S. Application Data

(63) Continuation of application No. 11/646,225, filed on Dec. 27, 2006, now Pat. No. 7,841,259.

(51) Int. Cl.
*B21K 5/04* (2006.01)

(52) U.S. Cl. ..... 76/108.2

(58) Field of Classification Search ..... 76/108.1–108.6
See application file for complete search history.

(56) References Cited

U.S. PATENT DOCUMENTS

| | | | |
|---|---|---|---|
| 1,954,166 | A | 4/1934 | Campbell |
| 2,507,439 | A | 5/1950 | Goolsbee |
| 2,819,958 | A | 1/1958 | Abkowitz et al. |
| 2,819,959 | A | 1/1958 | Abkowitz et al. |
| 2,906,654 | A | 9/1959 | Abkowitz |
| 3,368,881 | A | 2/1968 | Abkowitz et al. |
| 3,471,921 | A | 10/1969 | Feenstra |
| 3,660,050 | A | 5/1972 | Iler et al. |
| 3,757,879 | A | 9/1973 | Wilder et al. |
| 3,987,859 | A | 10/1976 | Lichte |
| 4,017,480 | A | 4/1977 | Baum |
| 4,047,828 | A | 9/1977 | Makely |

(Continued)

FOREIGN PATENT DOCUMENTS

| | | |
|---|---|---|
| AU | 695583 | 2/1998 |

(Continued)

OTHER PUBLICATIONS

"Boron Carbide Nozzles and Inserts," Seven Stars International webpage http://www.concentric.net/~ctkang/nozzle. shtml, printed Sep. 7, 2006 (8 pages).

(Continued)

*Primary Examiner* — Jason Daniel Prone
(74) *Attorney, Agent, or Firm* — TraskBritt

(57) ABSTRACT

Methods for forming bodies of earth-boring drill bits and other tools include milling a plurality of hard particles and a plurality of particles comprising a matrix material to form a mill product comprising powder particles, separating the particles into a plurality of particle size fractions. Some of the particles from the fractions may be combined to form a powder mixture, which may be pressed to form a green body. Additional methods include mixing a plurality of hard particles and a plurality of particles comprising a matrix material to form a powder mixture, and pressing the powder mixture with pressure having an oscillating magnitude to form a green body. In yet additional methods a powder mixture may be pressed within a deformable container to form a green body and drainage of liquid from the container is enabled as the powder mixture is pressed.

25 Claims, 8 Drawing Sheets

U.S. PATENT DOCUMENTS

| | | | |
|---|---|---|---|
| 4,094,709 | A | 6/1978 | Rozmus |
| 4,128,136 | A | 12/1978 | Generoux |
| 4,221,270 | A | 9/1980 | Vezirian |
| 4,229,638 | A | 10/1980 | Lichte |
| 4,233,720 | A | 11/1980 | Rozmus |
| 4,252,202 | A | 2/1981 | Purser, Sr. |
| 4,255,165 | A | 3/1981 | Dennis et al. |
| 4,306,139 | A | 12/1981 | Shinozaki et al. |
| 4,341,557 | A | 7/1982 | Lizenby |
| 4,389,952 | A | 6/1983 | Dreier et al. |
| 4,398,952 | A | 8/1983 | Drake |
| 4,499,048 | A | 2/1985 | Hanejko |
| 4,499,795 | A | 2/1985 | Radtke |
| 4,499,958 | A | 2/1985 | Radtke et al. |
| 4,526,748 | A | 7/1985 | Rozmus |
| 4,547,337 | A | 10/1985 | Rozmus |
| 4,552,232 | A | 11/1985 | Frear |
| 4,554,130 | A | 11/1985 | Ecer |
| 4,557,893 | A | 12/1985 | Jatkar et al. |
| 4,562,990 | A | 1/1986 | Rose |
| 4,596,694 | A | 6/1986 | Rozmus |
| 4,597,730 | A | 7/1986 | Rozmus |
| 4,620,600 | A | 11/1986 | Persson |
| 4,623,388 | A | 11/1986 | Jatkar et al. |
| 4,656,002 | A | 4/1987 | Lizenby et al. |
| 4,667,756 | A | 5/1987 | King et al. |
| 4,686,080 | A | 8/1987 | Hara et al. |
| 4,694,919 | A | 9/1987 | Barr |
| 4,743,515 | A | 5/1988 | Fischer et al. |
| 4,744,943 | A | 5/1988 | Timm |
| 4,809,903 | A | 3/1989 | Eylon et al. |
| 4,838,366 | A | 6/1989 | Jones |
| 4,871,377 | A | 10/1989 | Frushour |
| 4,919,013 | A | 4/1990 | Smith et al. |
| 4,923,512 | A | 5/1990 | Timm et al. |
| 4,956,012 | A | 9/1990 | Jacobs et al. |
| 4,968,348 | A | 11/1990 | Abkowitz et al. |
| 5,000,273 | A | 3/1991 | Horton et al. |
| 5,030,598 | A | 7/1991 | Hsieh |
| 5,032,352 | A | 7/1991 | Meeks et al. |
| 5,049,450 | A | 9/1991 | Dorfman et al. |
| 5,090,491 | A | 2/1992 | Tibbitts et al. |
| 5,101,692 | A | 4/1992 | Simpson |
| 5,150,636 | A | 9/1992 | Hill |
| 5,161,898 | A | 11/1992 | Drake |
| 5,232,522 | A | 8/1993 | Doktycz et al. |
| 5,281,260 | A | 1/1994 | Kumar et al. |
| 5,286,685 | A | 2/1994 | Schoennahl et al. |
| 5,348,806 | A | 9/1994 | Kojo et al. |
| 5,439,068 | A | 8/1995 | Huffstutler et al. |
| 5,443,337 | A | 8/1995 | Katayama |
| 5,482,670 | A | 1/1996 | Hong |
| 5,484,468 | A | 1/1996 | Ostlund et al. |
| 5,506,055 | A | 4/1996 | Dorfman et al. |
| 5,543,235 | A | 8/1996 | Mirchandani et al. |
| 5,560,440 | A | 10/1996 | Tibbitts |
| 5,593,474 | A | 1/1997 | Keshavan et al. |
| 5,611,251 | A | 3/1997 | Katayama |
| 5,612,264 | A | 3/1997 | Nilsson et al. |
| 5,641,251 | A | 6/1997 | Leins et al. |
| 5,641,921 | A | 6/1997 | Dennis et al. |
| 5,662,183 | A | 9/1997 | Fang |
| 5,677,042 | A | 10/1997 | Massa et al. |
| 5,679,445 | A | 10/1997 | Massa et al. |
| 5,697,046 | A | 12/1997 | Conley |
| 5,725,827 | A | 3/1998 | Rhodes et al. |
| 5,732,783 | A | 3/1998 | Truax et al. |
| 5,733,649 | A | 3/1998 | Kelley et al. |
| 5,733,664 | A | 3/1998 | Kelley et al. |
| 5,753,160 | A | 5/1998 | Takeuchi et al. |
| 5,765,095 | A | 6/1998 | Flak et al. |
| 5,776,593 | A | 7/1998 | Massa et al. |
| 5,778,301 | A | 7/1998 | Hong |
| 5,789,686 | A | 8/1998 | Massa et al. |
| 5,792,403 | A | 8/1998 | Massa et al. |
| 5,806,934 | A | 9/1998 | Massa et al. |
| 5,829,539 | A | 11/1998 | Newton et al. |
| 5,830,256 | A | 11/1998 | Northrop et al. |
| 5,856,626 | A | 1/1999 | Fischer et al. |
| 5,865,571 | A | 2/1999 | Tankala et al. |
| 5,880,382 | A | 3/1999 | Fang et al. |
| 5,897,830 | A | 4/1999 | Abkowitz et al. |
| 5,947,214 | A | 9/1999 | Tibbitts |
| 5,957,006 | A | 9/1999 | Smith |
| 5,963,775 | A | 10/1999 | Fang |
| 5,980,602 | A | 11/1999 | Carden |
| 6,029,544 | A | 2/2000 | Katayama |
| 6,045,750 | A | 4/2000 | Drake et al. |
| 6,051,171 | A | 4/2000 | Takeuchi et al. |
| 6,063,333 | A | 5/2000 | Dennis |
| 6,086,980 | A | 7/2000 | Foster et al. |
| 6,089,123 | A | 7/2000 | Chow et al. |
| 6,099,664 | A | 8/2000 | Davies et al. |
| 6,135,218 | A | 10/2000 | Deane et al. |
| 6,148,936 | A | 11/2000 | Evans et al. |
| 6,200,514 | B1 | 3/2001 | Meister |
| 6,209,420 | B1 | 4/2001 | Butcher et al. |
| 6,214,134 | B1 | 4/2001 | Eylon et al. |
| 6,214,287 | B1 | 4/2001 | Waldenstrom |
| 6,220,117 | B1 | 4/2001 | Butcher |
| 6,227,188 | B1 | 5/2001 | Tankala et al. |
| 6,228,139 | B1 | 5/2001 | Oskarsson |
| 6,241,036 | B1 | 6/2001 | Lovato et al. |
| 6,254,658 | B1 | 7/2001 | Taniuchi et al. |
| 6,287,360 | B1 | 9/2001 | Kembaiyan et al. |
| 6,290,438 | B1 | 9/2001 | Papajewski |
| 6,293,986 | B1 | 9/2001 | Rodiger et al. |
| 6,348,110 | B1 | 2/2002 | Evans |
| 6,375,706 | B2 | 4/2002 | Kembaiyan et al. |
| 6,454,025 | B1 | 9/2002 | Runquist et al. |
| 6,454,028 | B1 | 9/2002 | Evans |
| 6,454,030 | B1 | 9/2002 | Findley et al. |
| 6,458,471 | B2 | 10/2002 | Lovato et al. |
| 6,500,226 | B1 | 12/2002 | Dennis |
| 6,511,265 | B1 | 1/2003 | Mirchandani et al. |
| 6,576,182 | B1 | 6/2003 | Ravagni et al. |
| 6,589,640 | B2 | 7/2003 | Griffin et al. |
| 6,599,467 | B1 | 7/2003 | Yamaguchi et al. |
| 6,607,693 | B1 | 8/2003 | Saito et al. |
| 6,615,935 | B2 | 9/2003 | Fang et al. |
| 6,651,756 | B1 | 11/2003 | Costo, Jr., et al. |
| 6,655,481 | B2 | 12/2003 | Findley et al. |
| 6,685,880 | B2 | 2/2004 | Engstrom et al. |
| 6,742,611 | B1 | 6/2004 | Illerhaus et al. |
| 6,756,009 | B2 | 6/2004 | Sim et al. |
| 6,849,231 | B2 | 2/2005 | Kojima et al. |
| 6,908,688 | B1 | 6/2005 | Majagi et al. |
| 6,911,063 | B2 | 6/2005 | Liu |
| 6,918,942 | B2 | 7/2005 | Hatta et al. |
| 7,044,243 | B2 | 5/2006 | Kembaiyan et al. |
| 7,048,081 | B2 | 5/2006 | Smith et al. |
| 7,354,548 | B2 | 4/2008 | Liu |
| 7,513,320 | B2 | 4/2009 | Mirchandani et al. |
| 7,841,259 | B2 * | 11/2010 | Smith et al. ..... 76/108.2 |
| 8,079,429 | B2 * | 12/2011 | Smith et al. ..... 76/108.2 |
| 2003/0010409 | A1 | 1/2003 | Kunze et al. |
| 2004/0007393 | A1 | 1/2004 | Griffin |
| 2004/0013558 | A1 | 1/2004 | Kondoh et al. |
| 2004/0060742 | A1 | 4/2004 | Kembaiyan et al. |
| 2004/0134309 | A1 | 7/2004 | Liu |
| 2004/0196638 | A1 | 10/2004 | Lee et al. |
| 2004/0243241 | A1 | 12/2004 | Istephanous |
| 2004/0245024 | A1 | 12/2004 | Kembaiyan |
| 2005/0072496 | A1 | 4/2005 | Hwang et al. |
| 2005/0117984 | A1 | 6/2005 | Eason et al. |
| 2005/0126334 | A1 | 6/2005 | Mirchandani |
| 2005/0211475 | A1 | 9/2005 | Mirchandani et al. |
| 2005/0247491 | A1 | 11/2005 | Mirchandani et al. |
| 2005/0268746 | A1 | 12/2005 | Abkowitz et al. |
| 2006/0016521 | A1 | 1/2006 | Hanusiak et al. |
| 2006/0043648 | A1 | 3/2006 | Takeuchi et al. |
| 2006/0057017 | A1 | 3/2006 | Woodfield et al. |
| 2006/0131081 | A1 | 6/2006 | Mirchandani et al. |
| 2006/0165973 | A1 | 7/2006 | Dumm et al. |
| 2007/0034048 | A1 | 2/2007 | Liu |
| 2007/0042217 | A1 | 2/2007 | Fang et al. |
| 2007/0102198 | A1 | 5/2007 | Oxford et al. |

| | | | | |
|---|---|---|---|---|
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2008/0128176 | A1 | 6/2008 | Choe et al. | |
| 2008/0135304 | A1 | 6/2008 | Duggan et al. | |
| 2008/0135305 | A1 | 6/2008 | Smith et al. | |
| 2009/0031863 | A1 | 2/2009 | Lyons et al. | |
| 2010/0263935 | A1* | 10/2010 | Smith et al. | 76/108.2 |
| 2011/0030509 | A1* | 2/2011 | Stevens et al. | 76/108.4 |
| 2011/0094341 | A1* | 4/2011 | Choe et al. | 76/108.2 |
| 2011/0142707 | A1* | 6/2011 | Choe et al. | 419/17 |
| 2011/0186261 | A1* | 8/2011 | Choe et al. | 164/76.1 |
| 2011/0284179 | A1* | 11/2011 | Stevens et al. | 164/55.1 |
| 2011/0287238 | A1* | 11/2011 | Stevens et al. | 428/212 |

FOREIGN PATENT DOCUMENTS

| | | | |
|---|---|---|---|
| CA | 2212197 | | 10/2000 |
| CA | 2564082 | | 11/2005 |
| EP | 0453428 | A1 | 10/1991 |
| EP | 1 244 531 | B1 | 10/2002 |
| EP | 0995876 | A2 | 10/2002 |
| GB | 945227 | | 9/1980 |
| GB | 1574615 | | 9/1980 |
| GB | 2084350 | A | 4/1982 |
| GB | 2385350 | A | 8/2003 |
| GB | 2393449 | A | 3/2004 |
| JP | 10219385 | A | 8/1998 |
| WO | 0143899 | A1 | 6/2001 |
| WO | 03049889 | A2 | 6/2003 |
| WO | WO 2009149157 | A2 * | 12/2009 |
| WO | WO 2010022325 | A2 * | 2/2010 |

OTHER PUBLICATIONS

"Heat Treating of Titanium and Titanium Alloys," Key to Metals website article, www.key-to-metals.com, printed Sep. 21, 2006 (7 pages).

"Section 4.1.2. Fundamentals of Powder Mechanics and Packing," http://www.mmat.ubc.ca/courses/mmat382/sections/cnc412.doc, printed Dec. 26, 2006 (4 pages).

Alman et al., "The Abrasive Wear of Sintered Titanium Matrix-Ceramic Particle Reinforced Composites," Wear, 225-229 (1999), pp. 629-639.

Choe et al., "Effect of Tungsten Additions on the Mechanical Properties of Ti-6A1-4V," Materials Science and Engineering, A 396 (2005), pp. 99-106, Elsevier.

Diamond Innovations, "Composite Diamond Coatings, Superhard Protection of Wear Parts New Coating and Service Parts from Diamond Innovations" brochure, 2004 (7 pages).

Gale et al., Smithells Metals Reference Book, Eighth Edition (2003), Elsevier Butterworth Heinemann, 2 pages.

Lambe et al., "Soil Mechanics," Massachusetts Institute of Technology, John Wiley & Sons, Inc. (1969), pp. 232-235.

Miserez et al. "Particle Reinforced Metals of High Ceramic Content," Materials Science and Engineering A 387-389 (2004), pp. 822-831, Elsevier.

PCT International Search Report for International Application No. PCT/US2007/026052, mailed Aug. 27, 2008.

Reed, James S., "Chapter 13: Particle Packing Characteristics," Principles of Ceramics Processing, Second Edition, John Wiley & Sons, Inc. (1995), pp. 215-227.

U.S. Appl. No. 60/566,063, filed Apr. 28, 2004, entitled "Body Materials for Earth Boring Bits" to Mirchandani et al.

Warrier et al., "Infiltration of Titanium Alloy-Matrix Composites," Journal of Materials Science Letters, 12 (1993), pp. 865-868, Chapman & Hall.

Zavaliangos et al., "The Densification of Powder Mixtures Containing Soft and Hard Components Under Static and Cyclic Pressure," Acta Metallurgica Inc., Published by Elsevier Science Ltd., vol. 48 (2000), pp. 2565-2570.

Zavaliangos, Antonios, et al., "Influence of Pressure Oscillation on the Compaction of Powder Mixtures Containing Soft and Hard Components," Microstructural Investigation and Analysis, pp. 296-300, Copyright 2000 Wiley-VCH Veriag GmbH, Weinheim, ISBN: 3-527-30121-6.

Equipment for Cold Isostatic Pressing (English Title)—Zhoa Ru, Cooling Isostatic Pressure Equipment, Carbon Technology, Issue 6, Dec. 1985.

European Office Action for EP Application No. 07 863 167.8 dated Jun. 6, 2011, 6 pages.

US 4,966,627, 10/1990, Keshavan et al. (withdrawn)

* cited by examiner

METHODS OF FORMING BODIES OF EARTH-BORING TOOLS

CROSS-REFERENCE TO RELATED APPLICATION

This application is a continuation of U.S. patent application Ser. No. 11/646,225, filed Dec. 27, 2006, and published as U.S. Patent Application Publication No. US 2008/0156148 A1, now U.S. Pat. No. 7,841,259, issued Nov. 30, 2010, the disclosure of which is hereby incorporated herein by this reference in its entirety.

FIELD OF THE INVENTION

Embodiments of the present invention relate to methods for forming bit bodies of earth-boring tools that include particle-matrix composite materials, and to earth-boring tools formed using such methods.

BACKGROUND OF THE INVENTION

Rotary drill bits are commonly used for drilling boreholes or wells in earth formations. One type of rotary drill bit is the fixed-cutter bit (often referred to as a "drag" bit), which typically includes a plurality of cutting elements secured to a face region of a bit body. The bit body of a rotary drill bit may be formed from steel. Alternatively, the bit body may be formed from a particle-matrix composite material. A conventional earth-boring rotary drill bit 10 is shown in FIG. 1 that includes a bit body 12 comprising a particle-matrix composite material 15. The bit body 12 is secured to a steel shank 20 having an American Petroleum Institute (API) threaded connection portion 28 for attaching the drill bit 10 to a drill string (not shown). The bit body 12 includes a crown 14 and a steel blank 16. The steel blank 16 is partially embedded in the crown 14. The crown 14 includes a particle-matrix composite material 15, such as, for example, particles of tungsten carbide embedded in a copper alloy matrix material. The bit body 12 is secured to the steel shank 20 by way of a threaded connection 22 and a weld 24 extending around the drill bit 10 on an exterior surface thereof along an interface between the bit body 12 and the steel shank 20.

The bit body 12 may further include wings or blades 30 that are separated by junk slots 32. Internal fluid passageways (not shown) extend between the face 18 of the bit body 12 and a longitudinal bore 40, which extends through the steel shank 20 and partially through the bit body 12. Nozzle inserts (not shown) also may be provided at the face 18 of the bit body 12 within the internal fluid passageways.

A plurality of cutting elements 34 is attached to the face 18 of the bit body 12. Generally, the cutting elements 34 of a fixed-cutter type drill bit have either a disk shape or a substantially cylindrical shape. A cutting surface 35 comprising a hard, super-abrasive material, such as mutually bound particles of polycrystalline diamond, may be provided on a substantially circular end surface of each cutting element 34. Such cutting elements 34 are often referred to as "polycrystalline diamond compact" (PDC) cutting elements 34. The PDC cutting elements 34 may be provided along the blades 30 within pockets 36 formed in the face 18 of the bit body 12, and may be supported from behind by buttresses 38, which may be integrally formed with the crown 14 of the bit body 12. Typically, the cutting elements 34 are fabricated separately from the bit body 12 and secured within the pockets 36 formed in the outer surface of the bit body 12. A bonding material such as an adhesive or, more typically, a braze alloy may be used to secure the cutting elements 34 to the bit body 12.

During drilling operations, the drill bit 10 is secured to the end of a drill string, which includes tubular pipe and equipment segments coupled end-to-end between the drill bit 10 and other drilling equipment at the surface. The drill bit 10 is positioned at the bottom of a well borehole such that the cutting elements 34 are adjacent the earth formation to be drilled. Equipment such as a rotary table or top drive may be used for rotating the drill string and the drill bit 10 within the borehole. Alternatively, the shank 20 of the drill bit 10 may be coupled directly to the drive shaft of a down-hole motor, which then may be used to rotate the drill bit 10. As the drill bit 10 is rotated and weight-on-bit or other axial force is applied, drilling fluid is pumped to the face 18 of the bit body 12 through the longitudinal bore 40 and the internal fluid passageways (not shown). Rotation of the drill bit 10 causes the cutting elements 34 to scrape across and shear away the surface of the underlying formation. The formation cuttings mix with and are suspended within the drilling fluid and pass through the junk slots 32 and the annular space between the well borehole and the drill string to the surface of the earth formation.

Conventionally, bit bodies that include a particle-matrix composite material 15, such as the previously described bit body 12, have been fabricated in graphite molds using a so-called "infiltration" process. The cavities of the graphite molds are conventionally machined with a multi-axis machine tool. Fine features are then added to the cavity of the graphite mold by hand-held tools. Additional clay, which may comprise inorganic particles in an organic binder material, may be applied to surfaces of the mold within the mold cavity and shaped to obtain a desired final configuration of the mold. Where necessary, preform elements or displacements (which may comprise ceramic material, graphite, or resin-coated and compacted sand) may be positioned within the mold and used to define the internal passages, cutting element pockets 36, junk slots 32, and other features of the bit body 12.

After the mold cavity has been defined and displacements positioned within the mold as necessary, a bit body may be formed within the mold cavity. The cavity of the graphite mold is filled with hard particulate carbide material (such as tungsten carbide, titanium carbide, tantalum carbide, etc.). The preformed steel blank 16 then may be positioned in the mold at an appropriate location and orientation. The steel blank 16 may be at least partially submerged in the particulate carbide material within the mold.

The mold then may be vibrated or the particles otherwise packed to decrease the amount of space between adjacent particles of the particulate carbide material. A matrix material (often referred to as a "binder" material), such as a copper-based alloy, may be melted, and caused or allowed to infiltrate the particulate carbide material within the mold cavity. The mold and bit body 12 are allowed to cool to solidify the matrix material. The steel blank 16 is bonded to the particle-matrix composite material 15 that forms the crown 14 upon cooling of the bit body 12 and solidification of the matrix material. Once the bit body 12 has cooled, the bit body 12 is removed from the mold and any displacements are removed from the bit body 12. Destruction of the graphite mold typically is required to remove the bit body 12.

After the bit body 12 has been removed from the mold, the PDC cutting elements 34 may be bonded to the face 18 of the bit body 12 by, for example, brazing, mechanical affixation, or adhesive affixation. The bit body 12 also may be secured to the steel shank 20. As the particle-matrix composite material 15 used to form the crown 14 is relatively hard and not easily machined, the steel blank 16 may be used to secure the bit body 12 to the shank 20. Threads may be machined on an exposed surface of the steel blank 16 to provide the threaded connection 22 between the bit body 12 and the steel shank 20. The steel shank 20 may be threaded onto the bit body 12, and the weld 24 then may be provided along the interface between the bit body 12 and the steel shank 20.

BRIEF SUMMARY OF THE INVENTION

In some embodiments, the present invention includes methods that may be used to form bodies of earth-boring tools such as, for example, rotary drill bits, core bits, bi-center bits, eccentric bits, so-called "reamer wings," as well as drilling and other downhole tools. For example, methods that embody teachings of the present invention include milling a plurality of hard particles and a plurality of particles comprising a matrix material to form a mill product. The mill product may include powder particles, which may be separated into a plurality of particle size fractions. At least a portion of at least two of the particle size fractions may be combined to form a powder mixture, and the powder mixture may be pressed to form a green bit body, which then may be at least partially sintered. As another example, additional methods that embody teachings of the present invention may include mixing a plurality of hard particles and a plurality of particles comprising a matrix material to form a powder mixture, and pressing the powder mixture with pressure having an oscillating magnitude to form a green bit body. As yet another example, additional methods that embody teachings of the present invention may include pressing a powder mixture within a deformable container to form a green body and enabling drainage of liquid from the container as the powder mixture is pressed.

In additional embodiments, the present invention includes systems that may be used to form bodies of such drill bits and other tools. The systems include a deformable container that is disposed within a pressure chamber. The deformable container may be configured to receive a powder mixture therein. The system further includes at least one conduit providing fluid communication between the interior of the deformable container and the exterior of the pressure chamber.

The present invention, in yet further embodiments, includes drill bits and other tools (such as those set forth above) that are formed using such methods and systems.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1:
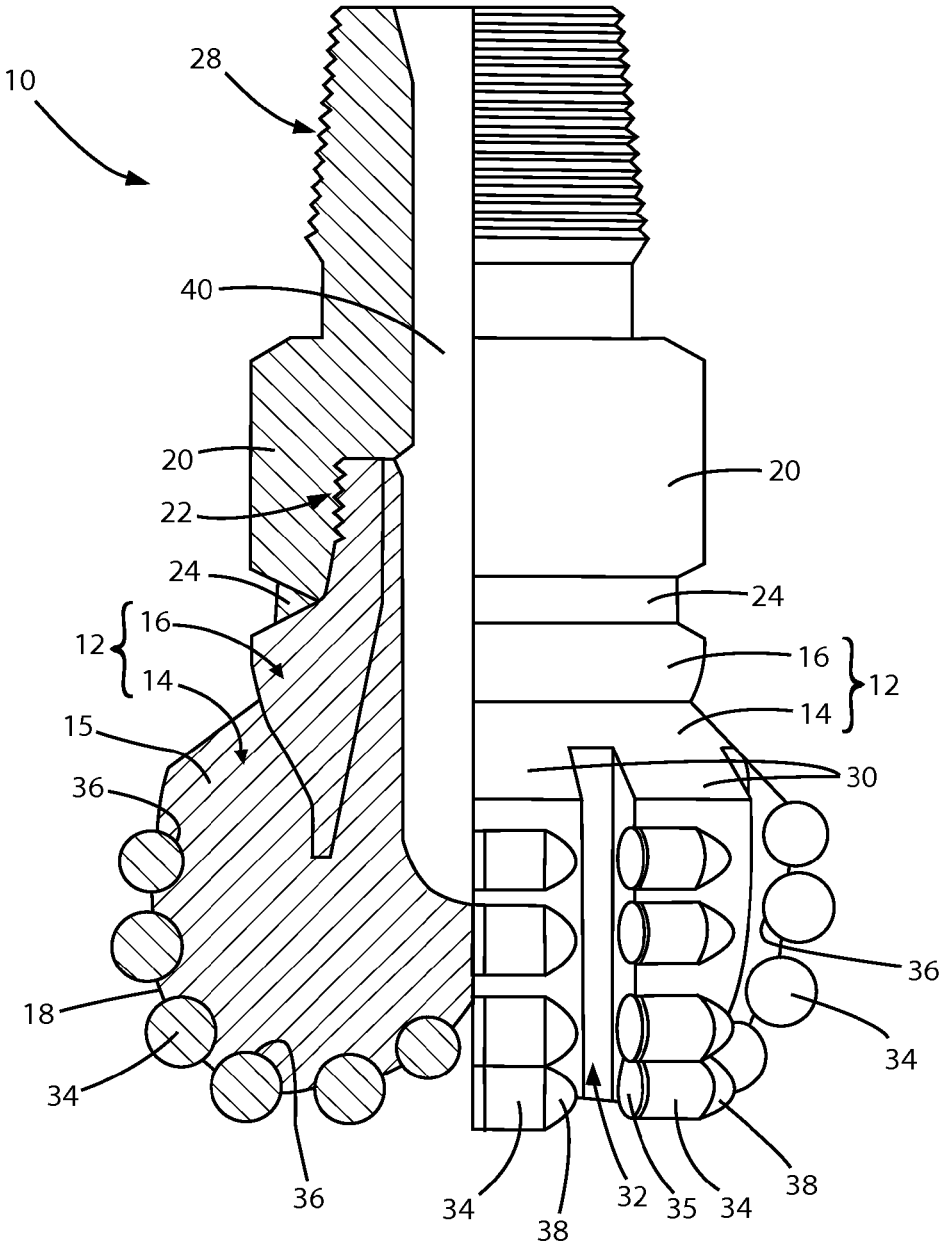
FIG. 1 (PRIOR ART)
FIG. 1 is a partial cross-sectional side view of a conventional earth-boring rotary drill bit having a bit body that includes a particle-matrix composite material.

The illustrations presented herein are not meant to be actual views of any particular material, apparatus, system, or method, but are merely idealized representations that are employed to describe the present invention. Additionally, elements common between figures may retain the same numerical designation.

The term "green" as used herein means unsintered.

The term "green bit body" as used herein means an unsintered structure comprising a plurality of discrete particles held together by a binder material, the structure having a size and shape allowing the formation of a bit body suitable for use in an earth-boring drill bit from the structure by subsequent manufacturing processes including, but not limited to, machining and densification.

The term "brown" as used herein means partially sintered.

The term "brown bit body" as used herein means a partially sintered structure comprising a plurality of particles, at least some of which have partially grown together to provide at least partial bonding between adjacent particles, the structure having a size and shape allowing the formation of a bit body suitable for use in an earth-boring drill bit from the structure by subsequent manufacturing processes including, but not limited to, machining and further densification. Brown bit bodies may be formed by, for example, partially sintering a green bit body.

The term "sintering" as used herein means densification of a particulate component involving removal of at least a portion of the pores between the starting particles (accompanied by shrinkage) combined with coalescence and bonding between adjacent particles.

As used herein, the term "[metal]-based alloy" (where [metal] is any metal) means commercially pure [metal] in addition to metal alloys wherein the weight percentage of [metal] in the alloy is greater than the weight percentage of any other component of the alloy.

As used herein, the term "material composition" means the chemical composition and microstructure of a material. In other words, materials having the same chemical composition but a different microstructure are considered to have different material compositions.

As used herein, the team "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

The depth of well bores being drilled continues to increase as the number of shallow depth hydrocarbon-bearing earth formations continues to decrease. These increasing well bore depths are pressing conventional drill bits to their limits in terms of performance and durability. Several drill bits are often required to drill a single well bore, and changing a drill bit on a drill string can be expensive, in terms of both equipment and in drilling time lost while tripping a bit out of the well bore.

New particle-matrix composite materials are currently being investigated in an effort to improve the performance and durability of earth-boring rotary drill bits. Furthermore, bit bodies comprising at least some of these new particle-matrix composite materials may be formed from methods other than the previously described infiltration processes. By way of example and not limitation, bit bodies that include new particle-matrix composite materials may be formed using powder compaction and sintering techniques. Examples of such techniques are disclosed in pending U.S. patent application Ser. No. 11/271,153, filed Nov. 10, 2005, now U.S. Pat. No. 7,802,495, issued Sep. 28, 2010, and pending U.S. patent application Ser. No. 11/272,439, also filed Nov. 10, 2005, now U.S. Pat. No. 7,776,256, issued Aug. 17, 2010, the disclosure of each of which is incorporated herein in its entirety by this reference.

Figure 2:
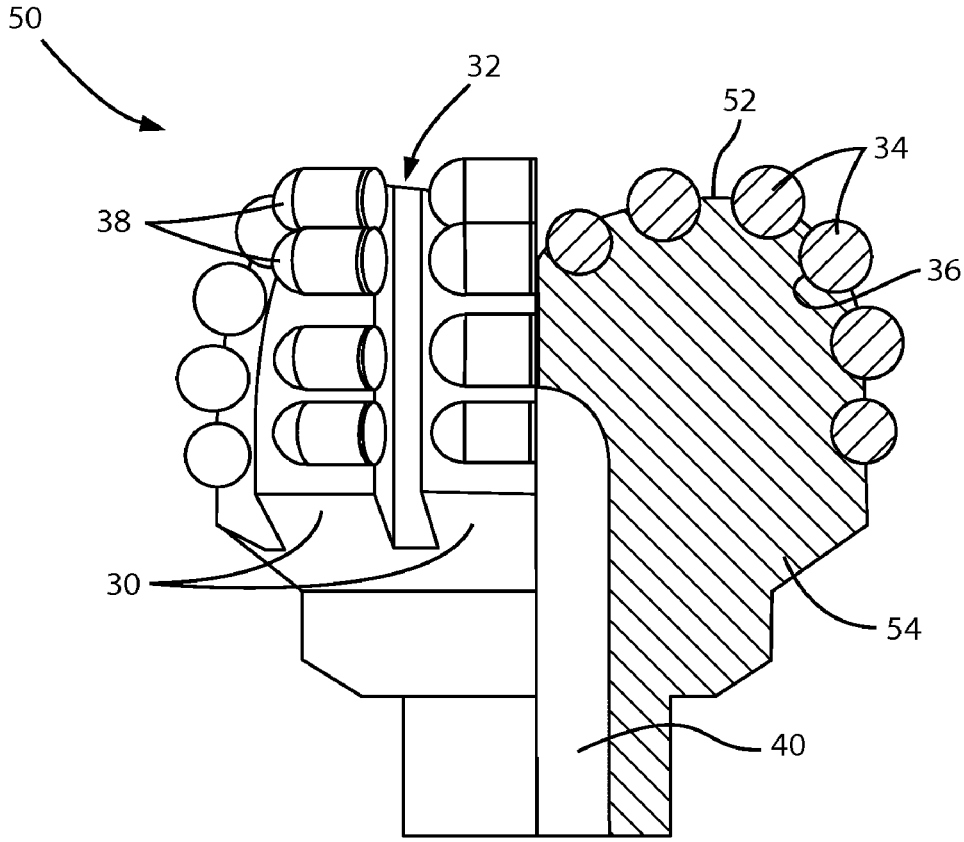
FIG. 2 is a partial cross-sectional side view of a bit body of a rotary drill bit that may be fabricated using methods that embody teachings of the present invention.

One example embodiment of a bit body 50 that may be formed using powder compaction and sintering techniques is illustrated in FIG. 2. As shown therein, the bit body 50 is similar to the bit body 12 previously described with reference to FIG. 1, and may include wings or blades 30 that are separated by junk slots 32, a longitudinal bore 40, and a plurality of cutting elements 34 (such as, for example, PDC cutting elements), which may be secured within cutting element pockets 36 on the face 52 of the bit body 50. The PDC cutting elements 34 may be supported from behind by buttresses 38, which may be integrally formed with the bit body 50. The bit body 50 may not include a steel blank, such as the steel blank 16 of the bit body 12 shown in FIG. 1. In some embodiments, the bit body 50 may be primarily or predominantly comprised of a particle-matrix composite material 54. Although not shown in FIG. 2, the bit body 50 also may include internal fluid passageways that extend between the face 52 of the bit body 50 and the longitudinal bore 40. Nozzle inserts (not shown) also may be provided at face 52 of the bit body 50 within such internal fluid passageways.

As previously mentioned, the bit body 50 may be formed using powder compaction and sintering techniques. One non-limiting example of such a technique is briefly described below.

Figure 3A:
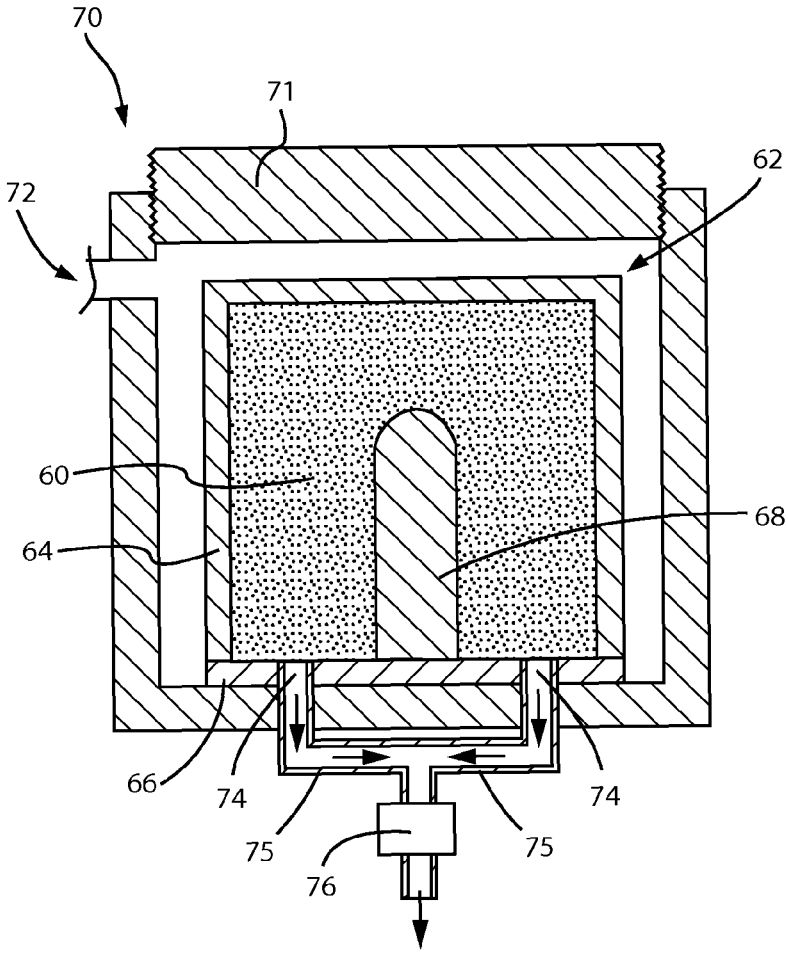
FIG. 3A is a cross-sectional view illustrating substantially isostatic pressure being applied to a powder mixture in a pressure vessel or container to form a green body from the powder mixture.

Referring to FIG. 3A, a system is illustrated that may be used to press a powder mixture 60. The system includes a pressure chamber 70 and a deformable container 62 that may be disposed within the pressure chamber 70. The system may further include one or more conduits 75 providing fluid communication between the interior of the deformable container 62 and the exterior of the pressure chamber 70, as described in further detail below.

A powder mixture 60 may be pressed with substantially isostatic pressure within the deformable container 62. The powder mixture 60 may include a plurality of hard particles and a plurality of particles comprising a matrix material. By way of example and not limitation, the plurality of hard particles may comprise a hard material such as diamond, boron carbide, boron nitride, aluminum nitride, and carbides or borides of the group consisting of W, Ti, Mo, Nb, V, Hf, Zr, Si, Ta, and Cr. Similarly, the matrix material may include a cobalt-based alloy, an iron-based alloy, a nickel-based alloy, a cobalt- and nickel-based alloy, an iron- and nickel-based alloy, an iron- and cobalt-based alloy, an aluminum-based alloy, a copper-based alloy, a magnesium-based alloy, or a titanium-based alloy.

Optionally, the powder mixture 60 may further include additives commonly used when pressing powder mixtures such as, for example, binders for providing structural strength to the pressed powder component, plasticizers for making the binder more pliable, and lubricants or compaction aids for reducing inter-particle friction and otherwise providing lubrication during pressing.

In some methods that embody teachings of the present invention, the powder mixture 60 may include a selected multimodal particle size distribution. By using a selected multimodal particle size distribution, the amount of shrinkage that occurs during a subsequent sintering process may be controlled. For example, the amount of shrinkage that occurs during a subsequent sintering process may be selectively reduced or increased by using a selected multimodal particle size distribution. Furthermore, the consistency or uniformity of shrinkage that occurs during a subsequent sintering process may be enhanced by using a selected multimodal particle size distribution. In other words, non-uniform distortion of a bit body that occurs during a subsequent sintering process may be reduced by providing a selected multimodal particle size distribution in the powder mixture 60.

As shrinkage during sintering is at least partially a function of the initial porosity (or interstitial spaces between the particles) in the green component formed from the powder mixture 60, a multimodal particle size distribution may be selected that provides a reduced or minimal amount of interstitial space between particles in the powder mixture 60. For example, a first particle size fraction may be selected that exhibits a first average particle size (e.g., diameter). A second particle size fraction then may be selected that exhibits a second average particle size that is a fraction of the first average particle size. The above process may be repeated as necessary or desired, to provide any number of particle size fractions in the powder mixture 60 selected to reduce or minimize the initial porosity (or volume of the interstitial spaces) within the powder mixture 60. In some embodiments, the ratio of the first average particle size to the second average particle size (or between any other nearest particle size fractions) may be between about 5 and about 20.

By way of example and not limitation, the powder mixture 60 may be prepared by providing a plurality of hard particles and a plurality of particles comprising a matrix material. The plurality of hard particles and the plurality of particles comprising a matrix material may be subjected to a milling process, such as, for example, a ball or rod milling process. Such processes may be conducted using, for example, a ball, rod, or attritor mill. As used herein, the term "milling," when used in relation to milling a plurality of particles as opposed to a conventional milling machine operation, means any process in which particles and any optional additives are mixed together to achieve a substantially uniform mixture. As a non-limiting example, the plurality of hard particles and the plurality of particles comprising a matrix material may be mixed together and suspended in a liquid to form a slurry, which may be provided in a generally cylindrical milling container. In some methods, grinding media also may be provided in the milling container together with the slurry. The grinding media may comprise discrete balls, pellets, rods, etc., comprising a relatively hard material and that are significantly larger in size than the particles to be milled (i.e., the hard particles and the particles comprising the matrix material). In some methods, the grinding media and/or the milling container may be formed from a material that is substantially similar or identical to the material of the hard particles and/or the matrix material, which may reduce contamination of the powder mixture 60 being prepared.

The milling container then may be rotated to cause the slurry and the optional grinding media to be rolled or ground together within the milling container. The milling process may cause changes in particle size in both the plurality of hard particles and the plurality of particles comprising a matrix material. The milling process may also cause the hard particles to be at least partially coated with a layer of the relatively softer matrix material.

After milling, the slurry may be removed from the milling container and separated from the grinding media. The solid particles in the slurry then may be separated from the liquid. For example, the liquid component of the slurry may be evaporated, or the solid particles may be filtered from the slurry.

After removing the solid particles from the slurry, the solid particles may be subjected to a particle separation process designed to separate the solid particles into fractions, each corresponding to a range of particle sizes. By way of example and not limitation, the solid particles may be separated into particle size fractions by subjecting the particles to a screening process, in which the solid particles may be caused to pass sequentially through a series of screens. Each individual screen may comprise openings having a substantially uniform size, and the average size of the screen openings in each screen may decrease in the direction of flow through the series of screens. In other words, the first screen in the series of screens may have the largest average opening size in the series of screens, and the last screen in the series of screens may have the smallest average opening size in the series of screens. As the solid particles are caused to pass through the series of screens, each particle may be retained on a screen having an average opening size that is too small to allow the respective particle to pass through that respective screen. As a result, after the screening process, a quantity of particles may be retained on each screen, the particles corresponding to a particular particle size fraction. In additional methods that embody teachings of the present invention, the particles may be separated into a plurality of particle size fractions using methods other than screening methods, such as, for example, air classification methods and elutriation methods.

As one particular non-limiting example, the solid particles may be separated to provide four separate particle size fractions. The first particle size fraction may have a first average particle size, the second particle size fraction may have a second average particle size that is approximately one-seventh the first average particle size, the third particle size fraction may have a third average particle size that is approximately one-seventh the second average particle size, and the fourth particle size fraction may have a fourth average particle size that is approximately one-seventh the third average particle size. For example, the first average particle size (e.g., average diameter) may be about five hundred microns (500 μm), the second average particle size may be about seventy microns (70 μm), the third average particle size may be about ten microns (10 μm), and the first average particle size may be about one micron (1 μm). At least a portion of each of the four particle size fractions then may be combined to provide the particle mixture 60. For example, the first particle size fraction may comprise about sixty percent (60%) by weight of the powder mixture 60, the second particle size fraction may comprise about twenty-five percent (25%) by weight of the powder mixture 60, the third particle size fraction may comprise about ten percent (10%) by weight of the powder mixture 60, and the fourth particle size fraction may comprise about five percent (5%) by weight of the powder mixture 60. In additional embodiments, the powder mixture 60 may comprise other weight percent distributions.

With continued reference to FIG. 3A, the container 62 may include a fluid-tight deformable member 64. For example, the fluid-tight deformable member 64 may be a substantially cylindrical bag comprising a deformable polymer material. The container 62 may further include a sealing plate 66, which may be substantially rigid. The deformable member 64 may be formed from, for example, an elastomer such as rubber, neoprene, silicone, or polyurethane. The deformable member 64 may be filled with the powder mixture 60.

Figure 4:
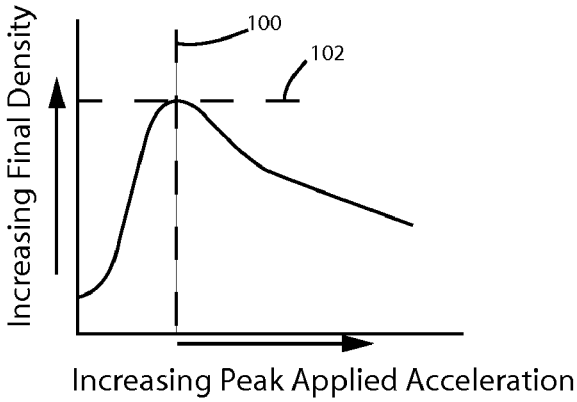
FIG. 4 is a graph illustrating an example of a potential relationship between the peak applied acceleration of vibrations applied to a powder mixture and the resulting final density of the powder mixture.

After the deformable member 64 is filled with the powder mixture 60, the powder mixture 60 may be vibrated to provide a uniform distribution of the powder mixture 60 within the deformable member 64. Vibrations may be characterized by, for example, the amplitude of the vibrations and the peak applied acceleration. By way of example and not limitation, the powder mixture 60 may be subjected to vibrations characterized by an amplitude of between about 0.25 millimeter (about 0.01 inch) and 2.50 millimeters (about 0.10 inch) and a peak applied acceleration of between about one-half the acceleration of gravity and about five times the acceleration of gravity. For any particular powder mixture 60, the resulting or final powder density may be measured after subjecting the powder to vibrations exhibiting a particular vibration amplitude at various peak applied accelerations. The resulting data obtained may be used to provide a graph similar to that illustrated in FIG. 4. As illustrated in FIG. 4, there may be an optimum peak applied acceleration 100 for a particular powder mixture 60 a vibration amplitude that results in a maximum or increased final powder density 102. As a result, by packing the particular powder mixture 60 using vibrations and an optimum peak applied acceleration, an increased or optimized final powder density may be obtained in the powder mixture 60.

Similar tests can be performed for a variety of vibration amplitudes to also identify a vibration amplitude that results in an increased or optimized final powder density. As a result, the powder mixture 60 may be vibrated at an optimum combination of vibration amplitude and peak applied acceleration to provide a maximum or optimum final powder density in the powder mixture 60. By providing a maximum or optimum final powder density in the powder mixture 60, any shrinkage that occurs during a subsequent sintering process may be reduced or minimized. Furthermore, by providing a maximum or optimum final powder density in the powder mixture 60, the uniformity of such shrinkage may be enhanced, which may provide increased dimensional accuracy upon shrinking.

Referring again to FIG. 3A, at least one insert or displacement member 68 may be provided within the deformable member 64 for defining features of the bit body 50 (FIG. 2) such as, for example, the longitudinal bore 40. Alternatively, the displacement member 68 may not be used and the longitudinal bore 40 may be formed using a conventional machining process during subsequent processes. The sealing plate 66 then may be attached or bonded to the deformable member 64 providing a fluid-tight seal therebetween.

The container 62 (with the powder mixture 60 and any desired displacement members 68 contained therein) may be provided within the pressure chamber 70. A removable cover 71 may be used to provide access to the interior of the pressure chamber 70. A gas (such as, for example, air or nitrogen) or a fluid (such as, for example, water or oil), which may be substantially incompressible, is pumped into the pressure chamber 70 through an opening 72 at high pressures using a pump (not shown). The high pressure of the gas or fluid causes the walls of the deformable member 64 to deform. The fluid pressure may be transmitted substantially uniformly to the powder mixture 60.

Figure 3B:
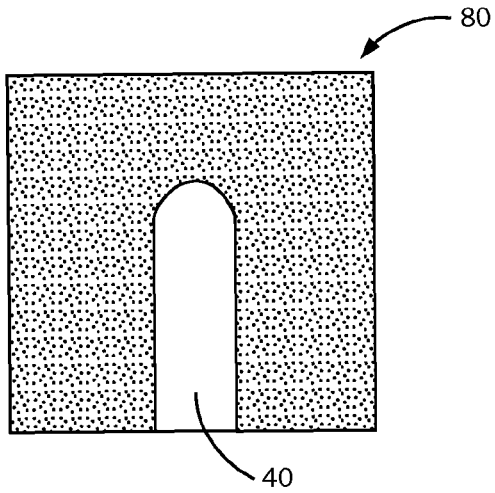
FIG. 3B is a cross-sectional view of the green body shown in FIG. 3A after removing the green body from the pressure vessel.

Such isostatic pressing of the powder mixture 60 may form a green powder component or green body 80 shown in FIG. 3B, which may be removed from the pressure chamber 70 and container 62 after pressing.

Figure 5A:
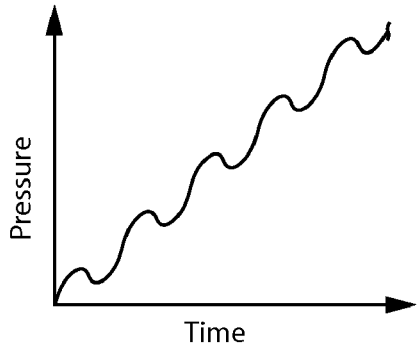
FIGS. 5A-5C are graphs illustrating examples of methods by which pressure may be applied to a powder mixture when forming a bit body of an earth-boring rotary drill bit from the powder mixture.
Figure 5B:
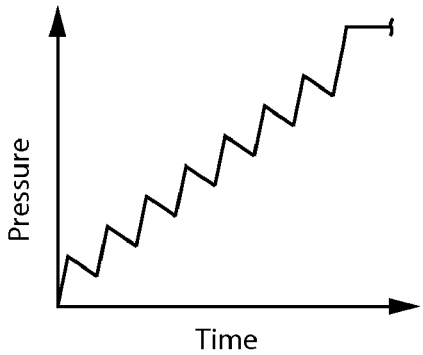

As the fluid is pumped into the pressure chamber 70 through the opening 72 to increase the pressure within the pressure chamber 70, the pressure may be increased substantially linearly with time to a selected maximum pressure. In additional methods, the pressure may be increased nonlinearly with time to a selected maximum pressure. FIG. 5A is a graph illustrating yet another example of a method by which the pressure may be increased within the pressure chamber 70. As shown in FIG. 5A, the pressure may be caused to oscillate up and down with a general overall upward trend. The pressure waves may have a generally sinusoidal or smoothly curved pattern, as also shown in FIG. 5A. Referring to FIG. 5B, in additional methods, the pressure waves may not have a smoothly curved pattern, and may have a plurality of relatively sharp peaks and valleys, as the pressure is oscillated up and down with a general overall upward trend. In yet additional methods, the pressure may be caused to oscillate up and down without any general overall upward trend for a selected period of time, after which the pressure may be increased to a desired maximum pressure, as shown in FIG. 5C.

Figure 5C:
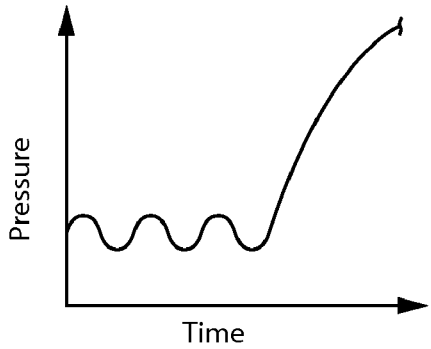

In some embodiments, the oscillations shown in FIGS. 5A-5C may have frequencies of between about one cycle per second (1 hertz) and about 100 cycles per second (100 hertz) (one cycle being defined as the portion of the graph defined between adjacent peaks). Furthermore, in some embodiments, the oscillations may have average amplitudes of between about six-thousandths of a megapascal (0.006 MPa) and about sixty-nine megapascals (69 MPa).

By subjecting the powder mixture 60 within the container 62 to pressure oscillations as described above, the final density achieved in the powder mixture 60 upon compaction may be increased. Furthermore, the uniformity of particle compaction in the powder mixture 60 may be enhanced by subjecting the powder mixture 60 within the container 62 to pressure oscillations. In other words, any density gradients within the green powder component or green body 80 may be reduced or minimized by oscillating the pressure applied to the powder mixture 60. By reducing any density gradients within the green powder component or green body 80, the green powder component or green body 80 may exhibit more dimensional accuracy during subsequent sintering processes.

As previously mentioned, the powder mixture 60 may include one or more additives such as, for example, binders for providing structural strength to the pressed powder component, plasticizers for making the binder more pliable, and lubricants or compaction aids for reducing inter-particle friction and otherwise providing lubrication during pressing. As the powder mixture 60 is pressurized in the container 62 within the pressure chamber 70, these additives may limit the extent to which the powder mixture 60 is compacted or densified in the container 62.

As shown in FIG. 3A, one or more ports or openings 74 may be provided in the container 62. For example, one or more openings 74 may be provided in the sealing plate 66. The openings 74 may be connected through the conduits 75 (e.g., hoses or pipes) to an outlet and/or a container (not shown). The conduits 75 provide fluid communication between the interior region of the deformable container 62 and the exterior of the pressure chamber 70, and enable drainage of liquid from the deformable container 62 as pressure is applied to the exterior surface of the deformable container 62. Optionally, one or more valves 76 may be used to control flow through the openings 74 and conduits 75 to the outlet and/or container, and/or to control the pressure within the conduits 75. By way of example and not limitation, the one or more valves 76 may include a flow control valve and a pressure control valve.

As the powder mixture 60 is pressurized within the container 62 in the pressure chamber 70, the additives within the powder mixture 60 may liquefy due to heat applied to the powder mixture 60. At least a portion of the liquefied additives may be removed from the powder mixture 60 through the openings 74 and the conduits 75, as indicated by the directional arrows shown within the conduits 75 in FIG. 3A, due to the pressure differential between the interior of the container 62 and the exterior of the pressure chamber 70. In some embodiments, a vacuum may be applied to the conduits 75 to facilitate removal of the excess liquefied additives from the powder mixture 60. The one or more valves 76 may be used to selectively control when the liquefied additives are allowed to escape from the container 62, as well as the quantity of the liquefied additives that is allowed to escape from the container 62.

In some embodiments, the additives in the powder mixture 60 may be selected to exhibit a melting point that is proximate (e.g., within about twenty degrees Celsius) ambient temperature (i.e., about twenty-two degrees Celsius) to facilitate drainage of excess additives from the powder mixture 60 as the powder mixture 60 is pressed within the deformable container 62. For example, one or more of the additives in the powder mixture 60 may have a melting temperature between about twenty-five degrees Celsius (25° C.) and about fifty degrees Celsius (50° C.). As one particular non-limiting example, the additives in the powder mixture 60 may be selected to include 1-tetra-decanol ($C_{14}H_{30}O$), which has a melting point of between about thirty-five degrees Celsius (35° C.) and about thirty-nine degrees Celsius (39° C.).

After allowing or causing excess liquefied additives to be removed from the powder mixture 60, the liquefied additives remaining within the powder mixture 60 may be caused to solidify. For example, the powder mixture 60 may be cooled to cause the liquefied additives remaining within the powder mixture 60 to solidify.

As one example of a method by which the powder mixture 60 may be heated and/or cooled within the pressure chamber 70, a heat exchanger (not shown) may be provided in direct physical contact with the exterior surfaces of the pressure chamber 70. For example, heated fluid may be caused to flow through the heat exchanger to heat the pressure chamber 70 and the powder mixture 60, and cooled fluid may be caused to flow through the heat exchanger to cool the pressure chamber 70 and the powder mixture 60. As another example, the powder mixture 60 may be heated and/or cooled within the pressure chamber 70 by selectively controlling (e.g., selective heating and/or selectively cooling) the temperature of the fluid within the pressure chamber 70 that is used to apply pressure to the exterior surface of the container 62 for pressurizing the powder mixture 60.

By allowing any excess liquefied additives within the powder mixture 60 to escape from the powder mixture 60 and the container 62 as the powder mixture 60 is compacted, the extent of compaction that is achieved in the powder mixture 60 may be increased. In other words, the density of the green body 80 shown in FIG. 3B may be increased by allowing any excess liquefied additives within the powder mixture 60 to escape from the powder mixture 60 as the powder mixture 60 is compacted.

In an alternative method of pressing the powder mixture 60 to form the green body 80 shown in FIG. 3B, the powder mixture 60 may be axially pressed (e.g., uni-axially pressed or multi-axially pressed) in a mold or die (not shown) using one or more mechanically or hydraulically actuated plungers.

The green body 80 shown in FIG. 3B may include a plurality of particles (hard particles and particles of matrix material) held together by a binder material provided in the powder mixture 60 (FIG. 3A), as previously described. Certain structural features may be machined in the green body 80 using conventional machining techniques including, for example, turning techniques, milling techniques, and drilling techniques. Hand held tools also may be used to manually form or shape features in or on the green body 80. By way of example and not limitation, blades 30, junk slots 32 (FIG. 2), and other features may be machined or otherwise formed in the green body 80 to form a partially shaped green body 84 shown in FIG. 3C.

Figure 3C:
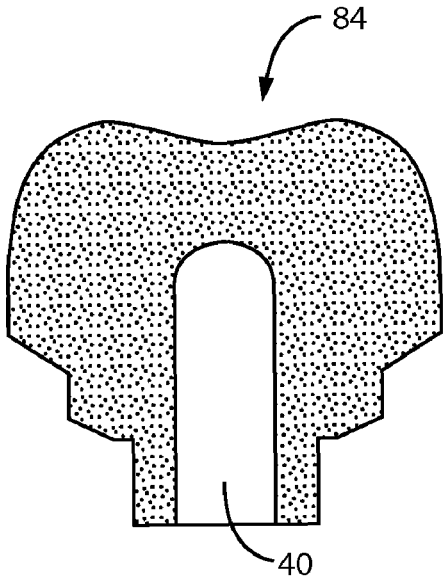
FIG. 3C is a cross-sectional view of another green body formed by machining the green body shown in FIG. 3B.
Figure 3D:
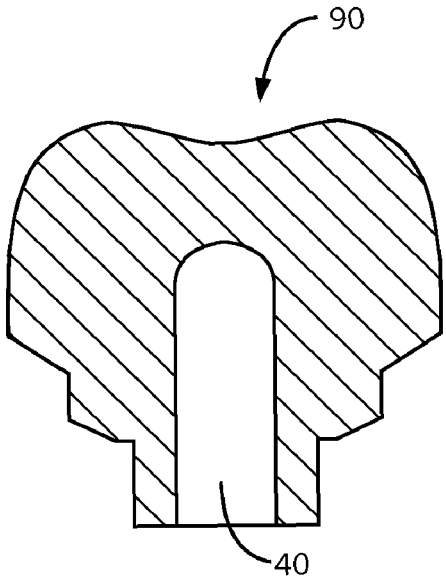
FIG. 3D is a cross-sectional view of a brown body that may be formed by partially sintering the green body shown in FIG. 3C.

The partially shaped green body 84 shown in FIG. 3C may be at least partially sintered to provide a brown body 90 shown in FIG. 3D, which has less than a desired final density. By way of example and not limitation, the partially shaped green body 84 shown in FIG. 3C may be at least partially sintered to provide a brown body 90 using any of the sintering methods described in U.S. Pat. No. 7,776,256. The brown body 90 may be substantially machinable due to the remaining porosity therein. Certain structural features may be machined in the brown body 90 using conventional machining techniques including, for example, turning techniques, milling techniques, and drilling techniques. Hand held tools also may be used to manually form or shape features in or on the brown body 90.

Figure 3E:
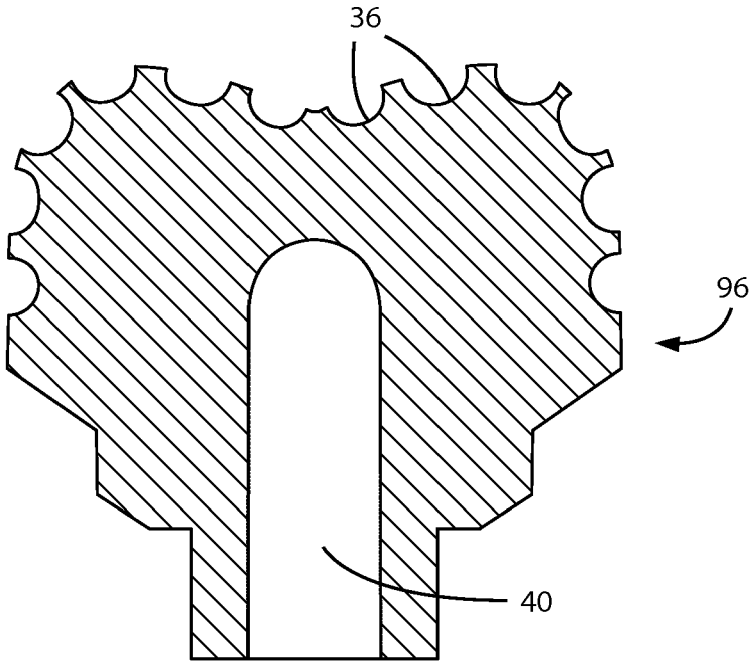
FIG. 3E is a cross-sectional view of another brown body that may be formed by partially machining the brown body shown in FIG. 3D.

By way of example and not limitation, internal fluid passageways (not shown), cutting element pockets 36, and buttresses 38 (FIG. 2) may be machined or otherwise formed in the brown body 90 to form a more fully shaped brown body 96 shown in FIG. 3E.

The brown body 96 shown in FIG. 3E then may be fully sintered to a desired final density to provide the previously described bit body 50 shown in FIG. 2. As sintering involves densification and removal of porosity within a structure, the structure being sintered will shrink during the sintering process. As a result, dimensional shrinkage must be considered and accounted for when machining features in green or brown bodies that are less than fully sintered.

In additional methods, the green body 80 shown in FIG. 3B may be partially sintered to form a brown body without prior machining, and all necessary machining may be performed on the brown body prior to fully sintering the brown body to a desired final density. In additional methods, all necessary machining may be performed on the green body 80 shown in FIG. 3B, which then may be fully sintered to a desired final density.

As the brown body 96 shown in FIG. 3E shrinks during sintering, geometric tolerances (e.g., size and shape) of the various features of the brown body 96 potentially may vary in an undesirable manner. Therefore, during sintering and partial sintering processes, refractory structures or displacement members 68 may be used to support at least portions of the green or brown bodies to attain or maintain desired geometrical aspects (such as, for example, size and shape) during the sintering processes. For example, any of the various embodiments of displacement members described in U.S. patent application Ser. No. 11/635,432, filed on Dec. 7, 2006, the disclosure of which application is incorporated herein in its entirety by this reference, may be used to support at least portions of the green or brown bodies to attain or maintain desired geometrical aspects (such as, for example, size and shape) during the sintering processes when conducting methods that embody teachings of the present invention.

Figure 3F:
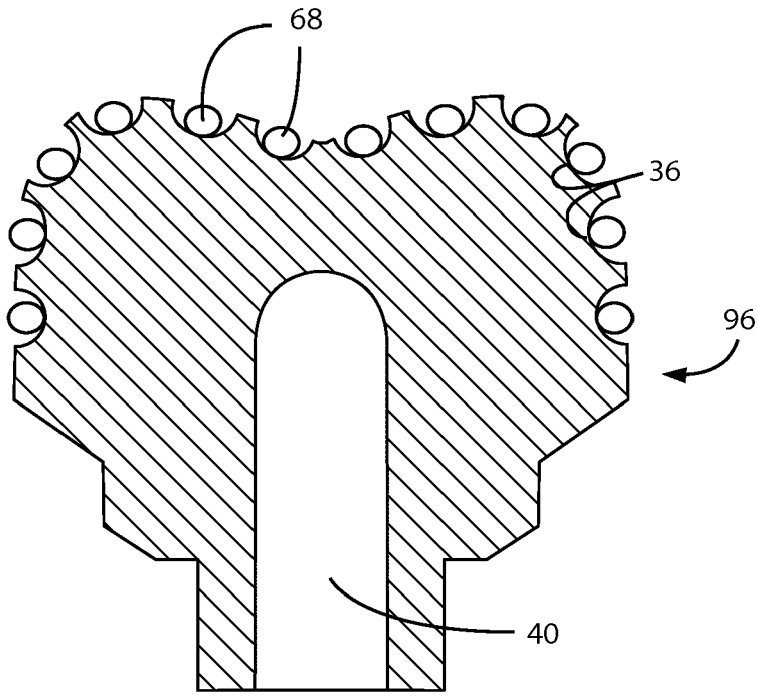
FIG. 3F is a cross-sectional view of the brown body shown in FIG. 3E illustrating displacement members that embody teachings of the present invention positioned in cutting element pockets thereof.

Referring to FIG. 3F, displacement members 68 may be provided in one or more recesses or other features formed in the shaped brown body 96, previously described with reference to FIG. 3E. For example, a displacement member 68 may be provided in each of the cutting element pockets 36. In some methods, the displacement members 68 may be secured at selected locations in the cutting element pockets 36 using, for example, an adhesive material. Although not shown, additional displacement members 68 may be provided in additional recesses or features of the shaped brown body 96, such as, for example, within fluid passageways, nozzle recesses, etc.

Figure 3G:
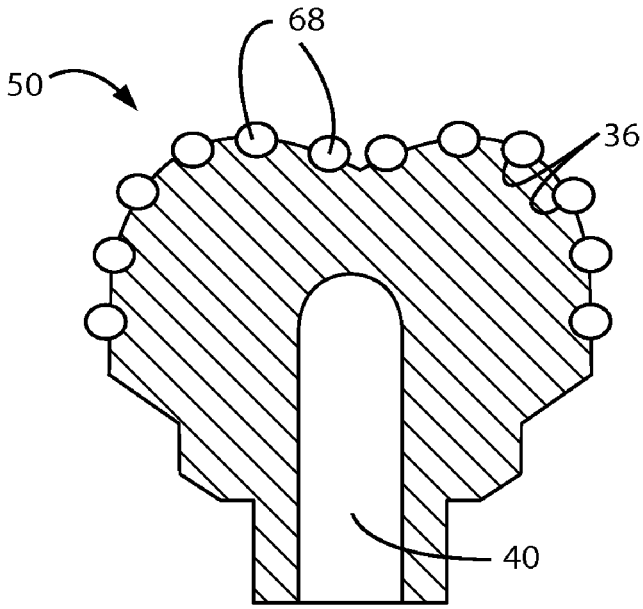
FIG. 3G is a cross-sectional side view of a bit body that may be formed by sintering the brown body shown in FIG. 3F to a desired final density and illustrates displacement members in the cutting element pockets thereof.

After providing the displacement members 68 in the recesses or other features of the shaped brown body 96, the shaped brown body 96 may be sintered to a final density to provide the fully sintered bit body 50 (FIG. 2), as shown in FIG. 3G. After sintering the shaped brown body 96 to a final density, however, the displacement members 68 may remain secured within the various recesses or other features of the fully sintered bit body 50 (e.g., within the cutting element pockets 36).

Figure 3H:
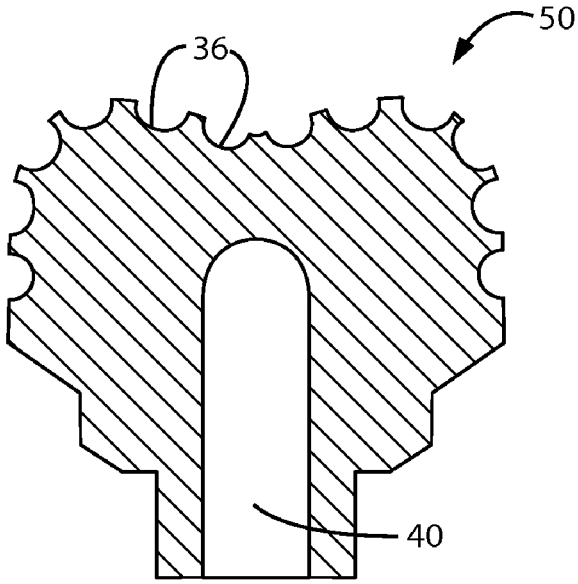
FIG. 3H is a cross-sectional side view of the bit body shown in FIG. 3G after removing the displacement members from the cutting element pockets.

Referring to FIG. 3H, the displacement members 68 may be removed from the cutting element pockets 36 of the bit body 50 to allow the cutting elements 34 (FIG. 2) to be subsequently secured therein. The displacement members 68 may be broken or fractured into relatively smaller pieces to facilitate removal of the displacement members 68 from the fully sintered bit body 50.

Figure 6:
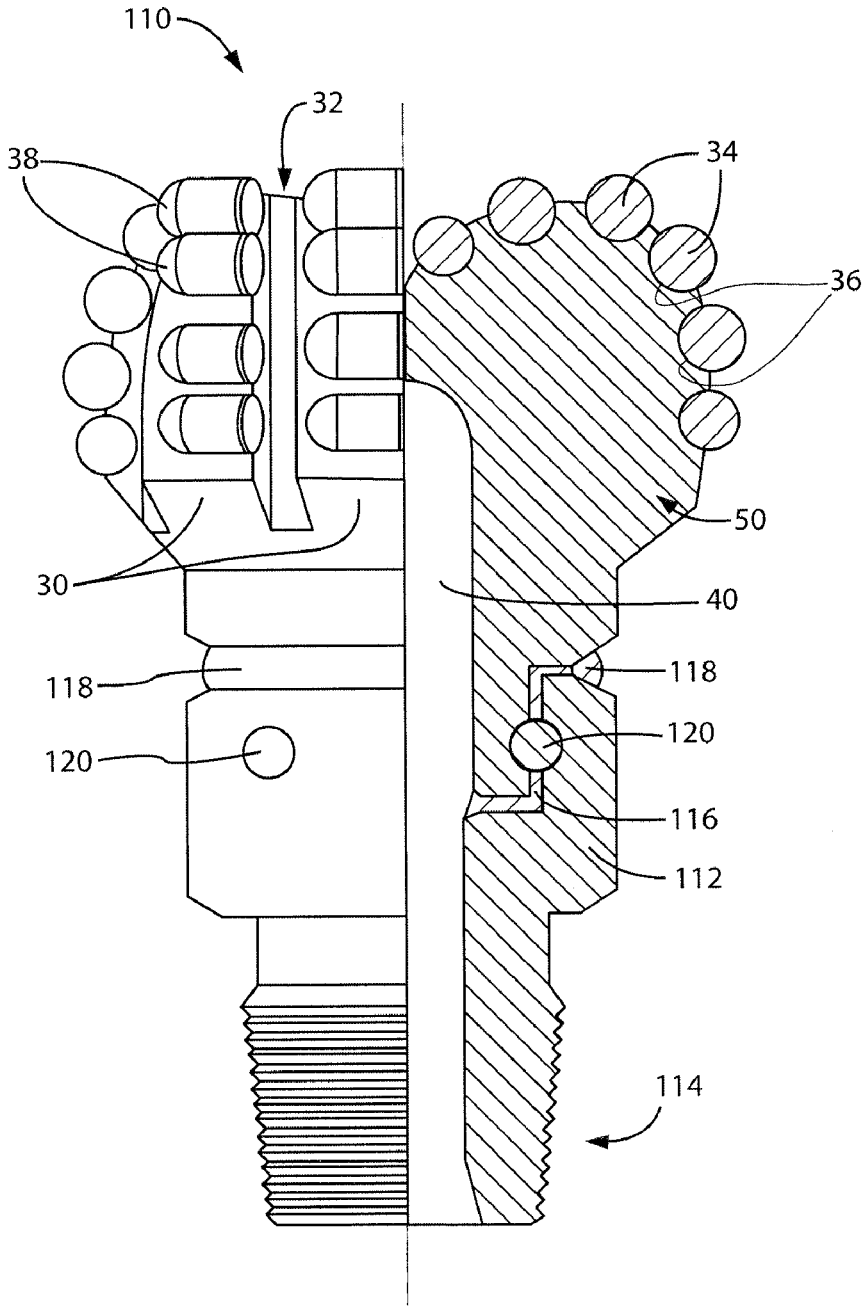
FIG. 6 is a partial cross-sectional side view of an earth-boring rotary drill bit that may be formed by securing cutting elements within the cutting element pockets of the bit body shown in FIG. 3H and securing the bit body to a shank for attachment to a drill string.

Referring to FIG. 6, after forming the bit body 50, cutting elements 34 may be secured within the cutting element pockets 36 to form an earth-boring rotary drill bit 110. The bit body 50 also may be secured to a shank 112 that has a threaded portion 114 for connecting the rotary drill bit 110 to a drill string (not shown). The bit body 50 also may be secured to the shank 112 by, for example, providing a braze alloy 116 or other adhesive material between the bit body 50 and the shank 112. In addition, a weld 118 may be provided around the rotary drill bit 110 along an interface between the bit body 50 and the shank 112. Furthermore, one or more pins 120 or other mechanical fastening members may be used to secure the bit body 50 to the shank 112. Such methods for securing the bit body 50 to the shank 112 are described in further detail in pending U.S. patent application Ser. No. 11/271,153, filed Nov. 10, 2005, now U.S. Pat. No. 7,802,495, issued Sep. 28, 2010.

While the methods, apparatuses, and systems that embody teachings of the present invention have been primarily described herein with reference to earth-boring rotary drill bits and bit bodies of such earth-boring rotary drill bits, it is understood that the present invention is not so limited. As used herein, the term "bit body" encompasses bodies of earth-boring rotary drill bits, as well as bodies of other earth-boring tools including, but not limited to, core bits, bi-center bits, eccentric bits, so-called "reamer wings," as well as drilling and other downhole tools.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A method of forming at least a portion of an earth-boring tool, the method comprising:

providing a powder mixture comprising a plurality of hard particles and a plurality of particles comprising a matrix material;

pressing the powder mixture to form a green body, wherein pressing the powder mixture comprises providing the powder mixture in a deformable container and applying pressure to at least one exterior surface of the deformable container;

draining liquid from the deformable container while applying pressure to the at least one exterior surface of the deformable container; and at least partially sintering the green body.

2. The method of claim 1, wherein providing the powder mixture comprising the plurality of hard particles and the plurality of particles comprising a matrix material comprises:

milling the plurality of hard particles and the plurality of particles comprising a matrix material to form a mill product comprising powder particles;

separating the powder particles into a plurality of particle size fractions; and combining at least a portion of at least two particle size fractions of the plurality of particle size fractions to provide a powder mixture.

3. The method of claim 2, wherein milling the plurality of hard particles and the plurality of particles comprising a matrix material comprises:

providing the plurality of hard particles and the plurality of particles comprising a matrix material in a container with a grinding media; and moving the grinding media relative to the plurality of hard particles and the plurality of particles comprising a matrix material to grind against the plurality of hard particles and the plurality of particles comprising a matrix material.

4. The method of claim 2, wherein combining at least a portion of at least two particle size fractions of the plurality of particle size fractions comprises combining at least a portion of less than all particle size fractions of the plurality of particle size fractions to provide the powder mixture.

5. The method of claim 2, wherein separating the powder particles comprises causing particles of the particle mixture to pass sequentially through each of a plurality of screens.

6. The method of claim 1, further comprising:

selecting the plurality of hard particles to comprise a material selected from the group consisting of diamond, boron carbide, boron nitride, aluminum nitride, and carbides or borides of the group consisting of W, Ti, Mo, Nb, V, Hf, Zr, Si, Ta, and Cr; and selecting the matrix material from the group consisting of cobalt-based alloys, iron-based alloys, nickel-based alloys, cobalt- and nickel-based alloys, iron- and nickel-based alloys, iron- and cobalt-based alloys, aluminum-based alloys, copper-based alloys, magnesium-based alloys, and titanium-based alloys.

7. The method of claim 1, further comprising subjecting the powder mixture to mechanical vibrations having an average amplitude and a peak applied acceleration that increases a final density in the powder mixture.

8. The method of claim 7, wherein the average amplitude is between about 0.25 millimeter and about 2.50 millimeters and the peak applied acceleration is between about one-half an acceleration of gravity and about five times an acceleration of gravity.

9. The method of claim 1, wherein pressing the powder mixture comprises pressing the powder mixture with substantially isostatic pressure.

10. The method of claim 9, wherein pressing the powder mixture with substantially isostatic pressure comprises selectively oscillating a magnitude of the substantially isostatic pressure.

11. The method of claim 10, wherein the selective oscillation of the magnitude of the substantially isostatic pressure has an average frequency of between about one cycle per second and about 100 cycles per second.

12. The method of claim 10, wherein the selective oscillation of the magnitude of the substantially isostatic pressure has an average oscillation amplitude of between about fourteen and six-thousandths of a megapascal (14.006 MPa) and about sixty-nine megapascals (69 MPa).

13. The method of claim 1, wherein at least partially sintering the green body comprises fully sintering the green body to a final density.

14. A method of forming at least a portion of an earth-boring tool, the method comprising:

separating a particle mixture comprising a plurality of hard particles and a plurality of particles comprising a matrix material into a plurality of particle size fractions;

combining at least a portion of at least two particle size fractions of the plurality of particle size fractions to provide a powder mixture;

providing the powder mixture in a deformable container; pressing the powder mixture with substantially isostatic pressure and selectively oscillating a magnitude of the substantially isostatic pressure to form a green body by applying pressure to at least one exterior surface of the deformable container;

draining liquid from the deformable container while applying pressure to the at least one exterior surface of the deformable container; and at least partially sintering the green body.

15. The method of claim 14, further comprising subjecting the powder mixture to mechanical vibrations having an average amplitude and a peak applied acceleration that increases a final density in the powder mixture.

16. The method of claim 15, wherein the average amplitude is between about 0.25 millimeter and about 2.50 millimeters and the peak applied acceleration is between about one-half an acceleration of gravity and about five times an acceleration of gravity.

17. The method of claim 14, wherein the selective oscillation of the magnitude of the substantially isostatic pressure has an average frequency of between about one cycle per second and about 100 cycles per second.

18. The method of claim 14, wherein the selective oscillation of the magnitude of the substantially isostatic pressure has an average oscillation amplitude of between about six-thousandths of a megapascal (0.006 MPa) and about sixty-nine megapascals (69 MPa).

19. The method of claim 14, wherein the isostatic pressure is a selected maximum pressure of greater than about thirty-five megapascals (35 MPa).

20. The method of claim 14, wherein at least partially sintering the green body comprises fully sintering the green body to a final density.

21. A method of forming at least a portion of an earth-boring tool, comprising:

combining a first plurality of hard particles and a first plurality of particles comprising a matrix material to form a first particle mixture having a first average particle size;

combining at least a second plurality of hard particles and at least a second plurality of particles comprising a matrix material to form at least a second particle mixture having at least a second average particle size;

selectively distributing the first particle mixture and the at least a second particle mixture in a deformable mold to impart a desired shrinkage characteristic to a resulting green body;

pressing the first particle mixture and the at least a second particle mixture in the deformable mold by applying pressure to at least one exterior surface of the deformable mold to form the green body;

draining liquid from the deformable mold while applying pressure to the at least one exterior surface of the deformable mold; and at least partially sintering the green body.

22. The method of claim 21, wherein selectively distributing the first particle mixture and the at least a second particle mixture in the deformable mold comprises selectively distributing the first particle mixture having a first average particle size, a second particle mixture having a second average particle size, and a third particle mixture having a third average particle size in the deformable mold.

23. The method of claim 21, wherein selectively distributing the first particle mixture and the at least a second particle mixture in the deformable mold comprises selectively distributing the first particle mixture having a first average particle size, a second particle mixture having a second average particle size, a third particle mixture having a third average particle size, and a fourth particle mixture having a fourth average particle size in the deformable mold.

24. The method of claim 23, wherein the first average particle size is about five hundred microns (500 μm), the second average particle size is about seventy microns (70 μm), the third average particle size is about ten microns (10 μm), and the fourth average particle size is about one micron (1 μm).

25. The method of claim 21, wherein at least partially sintering the green body comprises fully sintering the green body to a final density.

* * * * *